US008042450B2

(12) United States Patent
Doll et al.

(10) Patent No.: US 8,042,450 B2
(45) Date of Patent: Oct. 25, 2011

(54) SAFETY APPARATUS FOR FIREARMS

(75) Inventors: Stefan Doll, Oberndorf (DE); Josef Jakob, Rehling (DE); Johann Rager, Meitingen (DE); Peter Ertl, Aichach (DE)

(73) Assignee: Hecker & Koch GmbH, a German Corporation, Oberndorf/Neckar (DE)

( * ) Notice: Subject to any disclaimer, the term of this patent is extended or adjusted under 35 U.S.C. 154(b) by 0 days.

(21) Appl. No.: 12/756,860

(22) Filed: Apr. 8, 2010

(65) Prior Publication Data

US 2010/0257769 A1 Oct. 14, 2010

Related U.S. Application Data

(63) Continuation of application No. PCT/EP2008/008486, filed on Oct. 8, 2008.

(30) Foreign Application Priority Data

Oct. 8, 2007 (DE) ..... 10 2007 048 292

(51) Int. Cl.
*F41A 17/74* (2006.01)

(52) U.S. Cl. ..... 89/148; 89/150; 89/154; 42/70.01

(58) Field of Classification Search ..... 42/69.02, 42/70.04, 70.05, 70.08; 89/142, 148, 150, 89/154

See application file for complete search history.

(56) References Cited

U.S. PATENT DOCUMENTS 4,133,128 A * 1/1979 Brush ..... 42/70.01
4,475,437 A 10/1984 Sullivan
4,730,538 A * 3/1988 Zamacola ..... 89/154
(Continued)

FOREIGN PATENT DOCUMENTS

DE 101 63 003 B4 6/2009
(Continued)

OTHER PUBLICATIONS

International Bureau, "English Translation of the International Preliminary Report on Patentability," issued in connection with PCT application Serial No. PCT/EP2008/008486, mailed on Aug. 5, 2010 (6 pages).

(Continued)

*Primary Examiner* — Michael David
(74) *Attorney, Agent, or Firm* — Hanley, Flight and Zimmerman, LLC

(57) ABSTRACT

Safety apparatus for firearms are described. An example safety apparatus may be used with a firearm having a latch movable between a first position to retain a breech of the firearm and a second position to enable movement of the breech. The safety apparatus includes a biased safety mechanism coupled to the latch and movable between the first position and the second position. Additionally, the safety apparatus includes a safety device moveable between a locking position and a non-locking position. The safety device interacts with the biased safety mechanism when the safety device is in the locking position and the safety mechanism is in the first position to enable the biased safety mechanism to prevent a trigger force from moving the latch to the second position but to enable the latch to be deflected by a returning breech.

20 Claims, 3 Drawing Sheets

U.S. PATENT DOCUMENTS

| | | | | |
|---|---|---|---|---|
| 5,355,768 | A * | 10/1994 | Felk | 89/147 |
| 6,308,449 | B1 * | 10/2001 | Plebani | 42/70.08 |
| 6,718,680 | B2 * | 4/2004 | Roca et al. | 42/70.08 |
| 6,907,813 | B2 | 6/2005 | Gablowski | |
| 7,743,543 | B2 * | 6/2010 | Karagias | 42/69.02 |
| 7,802,511 | B2 * | 9/2010 | Doll et al. | 89/148 |
| 2004/0194615 | A1 | 10/2004 | Gablowski | |

FOREIGN PATENT DOCUMENTS

| | | | |
|---|---|---|---|
| WO | 03/054470 | A1 | 7/2003 |

OTHER PUBLICATIONS

Patent Cooperation Treaty, "International Search Report," issued by the International Searching Authority in connection with international counterpart PCT application No. PCT/EP2008/008486, mailed Mar. 25, 2009 , 4 pages.

Patent Cooperation Treaty, "International Preliminary Report on Patentability," issued by the International Searching Authority in connection with international counterpart PCT application No. PCT/EP2008/008486, mailed Jan. 12, 2010 , 14 pages.

* cited by examiner

SAFETY APPARATUS FOR FIREARMS

RELATED APPLICATION

This patent is a continuation of International Patent Application Serial No. PCT/EP2008/008486, filed Oct. 8, 2008, which claims priority to German Patent Application 10 2007 048 292.4, filed Oct. 8, 2007, both of which are hereby incorporated herein by reference in their entireties.

FIELD OF THE DISCLOSURE

This patent relates generally to safety apparatus and, more specifically, to safety apparatus for firearms.

BACKGROUND

Typically, when a fully automatic firearm is cocked, the breech travels toward the rear of the firearm and is there secured (e.g., locked) in a rear locking or latching position against a spring force of one or more closing springs. The firearm may be cocked manually. When a trigger of the firearm is actuated, a locking mechanism is released and the one or more closing springs move the breech in a breech path toward a front of the firearm. The movement of the breech causes a cartridge to be inserted into the breech path, locked in a cartridge chamber toward a front end of the breech path and thereafter ignited. After the breech is released, gas pressure or recoil created by the cartridge ignition moves the breech toward the rear of the firearm into the rear locking position and the empty cartridge casing is ejected. Cartridges may be fed into and/or ejected from the firearm via the movement of the breech and/or the gas pressure or recoil created by the cartridge ignition, for example.

Safety devices (e.g., firearm safeties) may be used that prevent the breech of a cocked firearm from being released and, thus, unintentionally firing a round. Some safety devices may be moved (e.g., mechanically moved) behind the trigger of the firearm. Other safety devices may secure the breech in the rear locking position. Because of the relationship between the safety device and the trigger, in some firearms, the trigger may only be retracted if the breech is in the rear locking position. In other firearms, the relationship between the safety device and the trigger substantially prevents the safety from being engaged (e.g., intentionally engaged) when the firearm is firing because the safety blocks the safety catch and keeps the trigger in the shooting position. Because the breech is thus not secured in the rear locking position, the one or more closing springs move the breech again toward the front of the firearm to begin the next firing cycle. Engaging the safety when the firearm is firing may cause the firearm to continuously fire even if the trigger is disengaged, for example.

Additional issues may arise in fully automated weapons that have remotely controlled safety devices. While these weapons are firing the safety device may activate because of a malfunction, such as a cable breaking or power failure. However, after a malfunction, the safety device may be actuated into position prior to the breech being in the rear locking position even if the trigger has been released because the breech takes a particular amount of time to reach the rear locking position. The particular amount of time that the breech takes to reach the rear locking position depends on the position of the breech. The rear locking position of the breech may be the only position in which the breech may be secured when the firearm is cocked.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

The examples described herein relate to example trigger devices and/or safety mechanisms used with firearms and/or weapons that reduce and/or eliminate at least some issues encountered with known devices.

The examples described herein relate to example safety mechanisms for a latch of a trigger device. The trigger device may be used with weapons such as automatic weapons having a breech and a safety device. The latch of the trigger device may be moved to a locking position to lock the breech and a non-locking position that does not lock the breech.

Figure 3:
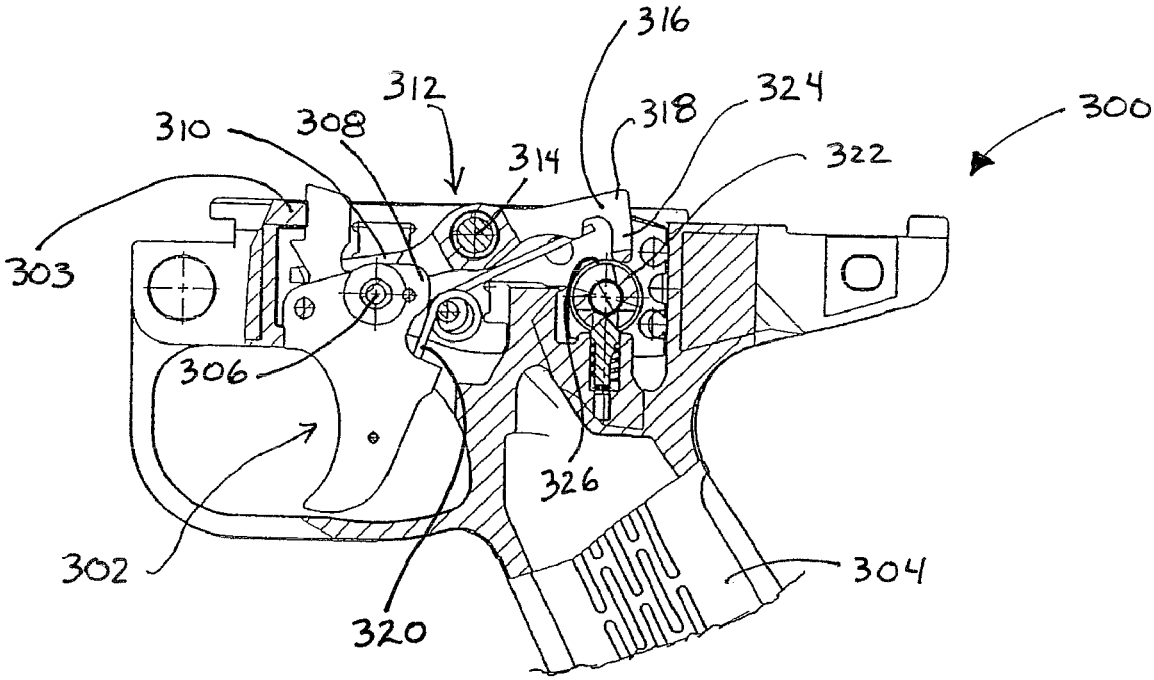
FIGS. 3 and 4 depict different positions of a known trigger assembly.
Figure 4:
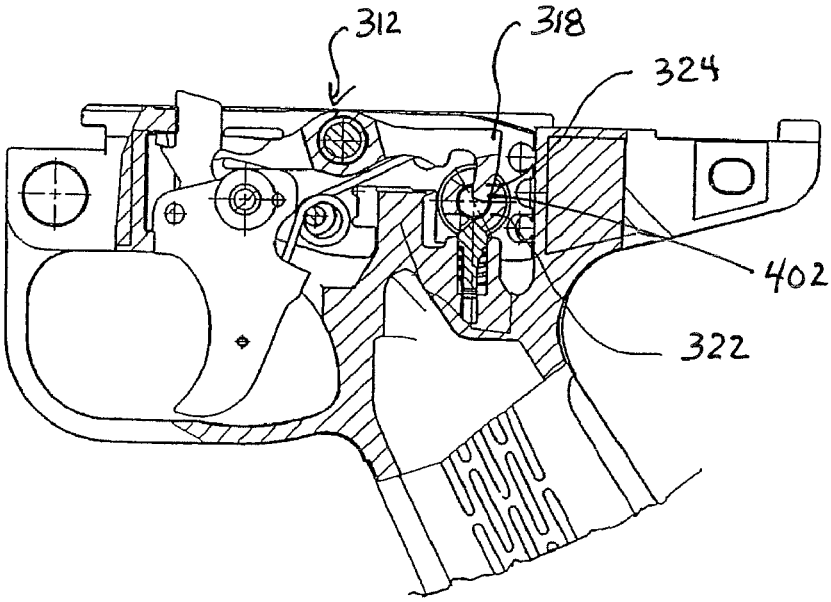

Turning initially to FIGS. 3 and 4, a known trigger mechanism or assembly 300 is depicted that may be used in connection with automatic weapons such as pistols and/or rifles (e.g., machine guns). Automatic weapons are weapons that provide continuous fire.

The trigger mechanism 300 includes a trigger 302 that is swivel-mounted on a housing or hand piece 303 adjacent a grip or handle 304. A rotation axis 306 of the trigger 302 transversely extends adjacent an upper region 308 of the trigger 302. As the trigger 302 is actuated, the upper region 308 moves in a curved upward path and impacts a first or front end 310 of a latch 312. The latch 312 is swivel mounted about a transverse axis 314 to the housing or hand piece 303. A second or rear end 316 of the latch 312 is a sear arm 318.

If a spring 320 pivots the trigger 302 into a neutral position, the front end 310 of the latch 312 moves downward and the rear end 316 of the latch 312 moves upward. The latch 312 may be biased by the spring 320. FIG. 3 depicts a locking position of the sear arm 318. The trigger 302 and/or the latch 312 may be cushioned and/or pretensioned by the spring 320. The spring 320 may urge the trigger 302 into a neutral position and/or the latch 312 into a locking position.

As a breech (not shown) is retracted from a neutral position, a surface or bottom surface of the breech engages the sear arm 318 moving the rear end 316 of the latch 312 downward. If the breech includes a sear catch (not shown), after the sear catch moves over the sear arm 318, the sear arm 318 moves upward behind the sear catch to secure the breech in the rear position. With the sear arm 318 behind the sear catch, the weapon is tensioned and ready to fire.

If the trigger 302 is actuated, the sear arm 318 is lowered until the sear arm 318 releases the sear catch and, thus, the breech. Releasing the breech causes the weapon to begin firing (e.g., continuously firing). By releasing the trigger 302, the sear arm 318 moves upward into the locking position enabling the sear arm 318 to be positioned behind the sear catch and retain the breech in the rear position (e.g., the weapon is tensioned and ready to fire). The continuous firing of the weapon is interrupted (e.g., stopped) when the trigger 302 is released and the breech is retained in the rear position.

In some instances, the safety device is a trigger safety that substantially prevents unintentional activation of the weapon. However, because of acceleration forces, these trigger safeties may not prevent the sear arm 318 from yielding (e.g., moving out of the locking position) if a loaded, pretensioned machine gun having its trigger safety engaged falls off a truck, for example.

A safety device, mechanism or safety drum 322 may fix or secure the latch 312 in the locking position. In other examples, the safety device 322 may secure the latch 312 and a safety finger 324 in the locking position. However, securing the latch 312 in the locking position via the safety device 322 may prevent the breech from retracting beyond the latch 312. Additionally or alternatively, because in the locking position the latch 312 is unable to yield when the safety device 322 is engaged, the breech may become jammed on the latch 312 as the breech retracts.

FIG. 3 depicts a surface or peripheral surface 326 of the safety device 322 engaging and/or interacting with the safety finger 324. A firearm and/or weapon having the safety device 322 is unable to be cocked when the safety is engaged.

Weapons stations are increasingly including fully automated weapons having trigger mechanisms such as the trigger mechanism 300, for example. The weapons or mounted weapons of the weapons stations may be adjusted by remote control using actuators (e.g., electromagnetically controllable actuators). The actuators may interact with and/or impact the trigger (e.g., the trigger 302) and/or the safety mechanism (e.g., the safety device 322). To substantially ensure the weapons stations operate in a safe manner, if a malfunction occurs (e.g., power loss), activation of the trigger stops (e.g., the actuator stops impacting the trigger) and the safety mechanism is set on safety (e.g., the actuator moves the safety mechanism into the safety position). Stopping the activation of the trigger and setting the safety mechanism to the safety position may occur independently of one another.

If the latch 312 is secured in the locking position, the breech may be prevented from retracting and, thus, the gun may not be cocked. Additionally or alternatively, as shown in FIG. 4, high forces of the actuator used to move the safety device 322 to the safety position may engage and jam (e.g., retain) the safety finger 324. The interaction between the safety device 322 and the safety finger 324 may prevent the sear arm 318 from moving upward behind the sear catch to retain the breech in the rear position. If the breech is unretained, the weapon will continuously fire even if trigger activation is interrupted (e.g., stopped).

For example, with the trigger activated and the breech moving toward the front of the weapon, a power failure (e.g., a malfunction) may simultaneously initiate the release of the trigger and the actuator to move the safety device 322 to the safety position. Prior to the latch 312 moving upward into the locking position, the safety finger 324 is positioned in a safety recess 402 of the safety device 322 that substantially blocks or prevents the safety device 322 from moving into the safety position. After a malfunction, as the safety device 322 moves toward the safety position, a surface of the safety recess 402 may engage and hold the safety finger 324 in the unlocked position against the biasing force of the spring 320. The sear arm 318 does not retain the breech when in the unlocked position and, thus, the breech moves back and forth firing the weapon until the ammunition supply is exhausted (e.g., interrupted).

DE 101 63 003 A1, US 2004/0194615 A1 or U.S. Pat. No. 6,907,813 B2 describe trigger devices including sear arms having a pivoting safety pawl. As the breech moves toward the rear of the weapon, the safety pawl pivots against a spring force from a locking position to an unlocked position (e.g., position of evasion) enabling the breech to travel over the safety pawl (e.g., overrun the safety pawl). As the breech moves toward the front of the weapon, a spring urges the sear arm of the safety pawl to engage the sear catch. The sear arm is retained in the locking position by the breech. The safety pawl includes a safety element that interacts with a safety mechanism (e.g., a safety drum) to enable the safety element to independently move to the safety position regardless of the position of the breech or the latch. The safety mechanism can at the same time affect the trigger and the latch.

The trigger device includes an additional spring element to ensure the locking function. To retain the breech, the safety pawl and a swing mount of the safety pawl accept the full force of the forward traveling breech. The safety pawl and the corresponding swing mount may be relatively small and may be exposed to relatively high dynamic loads. If the safety pawl, the corresponding swing mount and/or the spring element malfunction or break, the weapon may continue to fire until the ammunition runs out independent of the position of the safety mechanism and the trigger. The actuating force of the spring element and the spring force affecting the latch are precisely adjusted to substantially ensure that the breech traveling over (e.g., overrunning) the safety pawl does not also push the latch downward into the hand piece. If the spring force is not precisely adjusted, the interaction between the safety element and the safety drum may be damaged.

Figure 1:
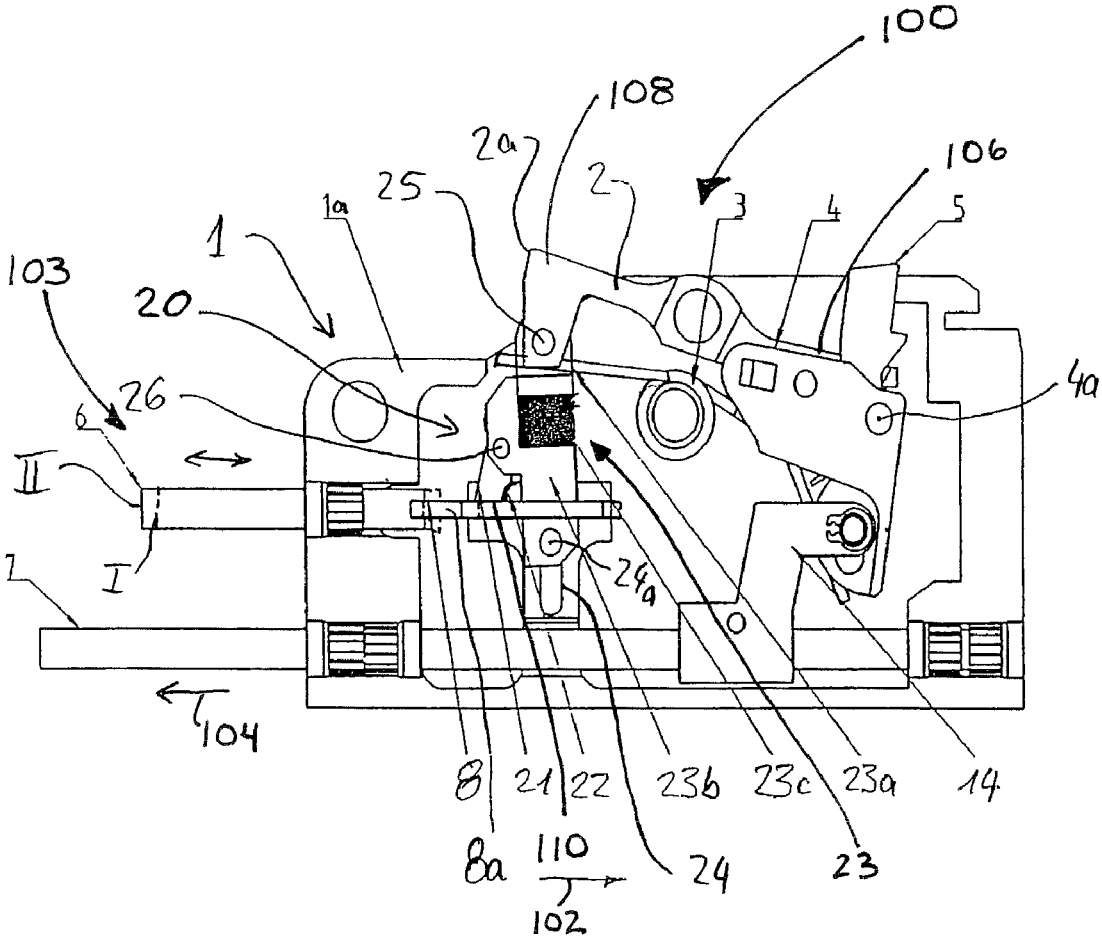
FIG. 1 depicts an example trigger assembly.

FIG. 1 depicts an example trigger assembly 100 and a hand piece 1 having a housing 1*a*. The hand piece 1 may be used with weapons and/or firearms such as machine guns. The hand piece 1 is depicted transverse to the firing direction 102. The hand piece 1 and/or the trigger assembly 100 includes a latch 2 having an attached hinge spring or spring 3. The spring 3 urges the latch 2 into a locking position that enables a sear arm 2*a* of the latch 2 to engage a sear catch of the breech and, thus, retain the breech in the rear position.

A firing mechanism or apparatus 4 is connected or coupled (e.g., pivotably coupled) to the latch 2. The latch 2 is moveable between a first or locking position to retain a breech and a second or non-locking position to enable movement of the breech. The hand piece 1 and/or the trigger assembly 100 includes a pre-release lever or lever 5 for the latch 2. The hand piece 1 and/or the trigger assembly 100 includes a securing rod 6 and a firing or trigger rod 7 that extend or protrude from the housing 1*a*. A locking plate or plate 8 is connected and/or coupled to the securing rod 6.

The hand piece 1 and/or the trigger assembly 100 includes an example safety mechanism, biased safety mechanism or apparatus 20. The safety mechanism 20 includes a biased or locking catch 21, a leaf spring, spring or biasing element 22 and a slide lock or pusher 23. The slide lock 23 includes a first pusher or portion 23*a* and a second pusher or portion 23*b*. The first pusher 23*a* may be hingably or pivotably coupled to the latch 2 and may be coupled in the linear direction to the second pusher 23*b*, for example. The second pusher 23*b* is moveable within and/or relative to a sliding guide or slot 24 and may be pivotable about a pivot point 24*a*. A spring assembly or biasing element 23*c* may be positioned between the first and second pushers 23*a* and 23*b*. The spring assembly 23*c* may bias the first pusher 23*a* relative to the second pusher 23*b* and the latch 2. The spring assembly 23*c* may bias the first pusher 23*a* relative to the latch 2 via a coupling joint or pivot point 25.

The firing mechanism 4 includes a pulling block 14 that is operatively coupled and/or linked to the firing rod 7. If the firing rod 7 along with the pulling block 14 are moved in a direction generally represented by arrow 104, the pulling block 14 interacts with the firing mechanism 4 and swivels or pivots the firing mechanism 4 clockwise about a pivot point 4*a*.

An example safety device or apparatus 103 includes the securing rod 6 and the locking plate 8 that is coupled thereto. The locking plate 8 and the securing rod 6 may be positioned in a first or locking positioned I (e.g., safety position) (represented by dashed lines) or a second, non-locking or unlocked position II (represented by solid lines). In the locking position I, a securing section, portion or surface 8*a* of the locking plate 8 supports the locking catch 21. However, in the unlocked position II, the securing section 8*a* releases the locking catch 21 (e.g., enabling the locking catch 21 to move downward relative to the securing section 8*a*).

If the securing rod 6, the locking plate 8 and the securing section 8*a* (e.g., the safety device 103) are in the unlocked position II and the firing rod 7 is actuated (e.g., moved) in a direction generally represented by arrow 104, the pulling block 14 moves (e.g., pivots) the firing mechanism 4 clockwise about the pivot point 4*a* such that the firing mechanism 4 lifts or moves a first or front end 106 of the latch 2 upwards against a spring force exerted by the spring 3 on a second or rear end 108 of the latch 2. By moving the front end 106 of the latch 2 upwards, the rear end 108 of the latch 2 moves downwards enabling the sear arm 2*a* to release the sear catch of the breech. One or more closing springs then move the sear catch and the breech toward the front of the firearm. The forward movement of the breech supplies and locks a cartridge into a cartridge chamber and releases a round, for example.

Figure 2:
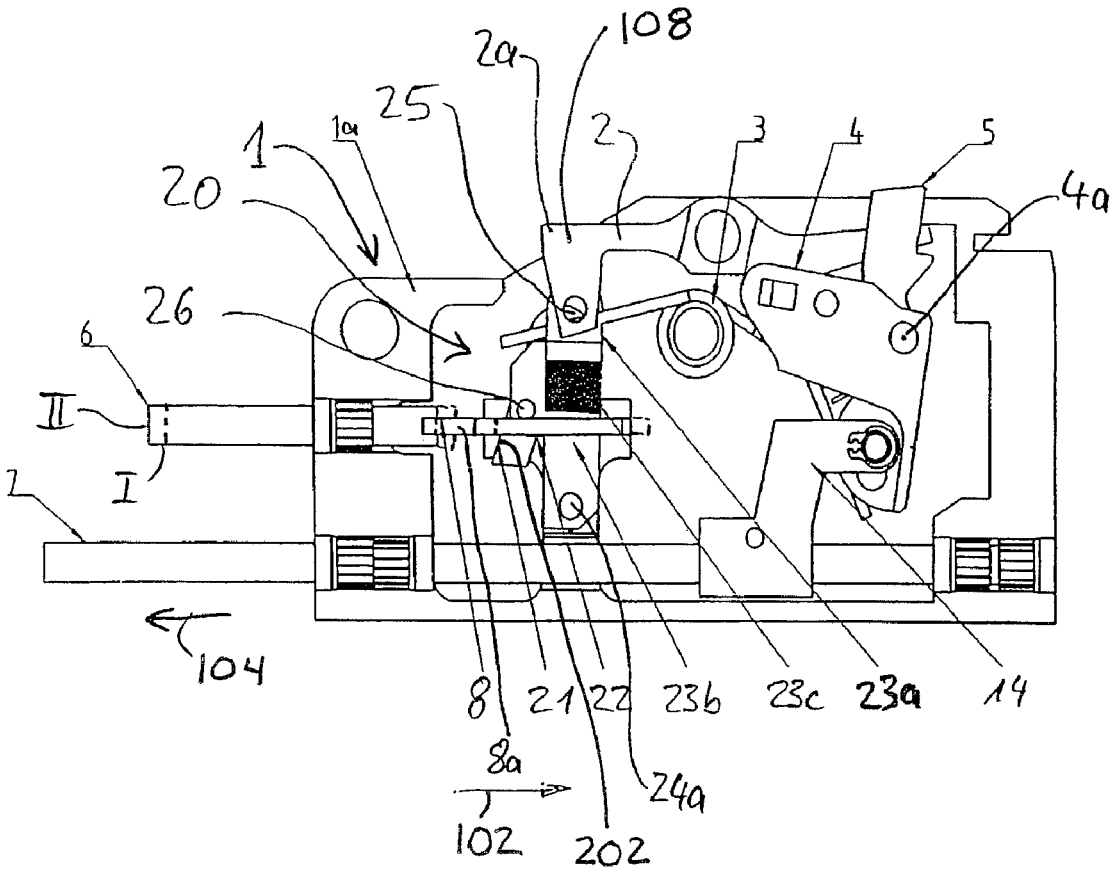
FIG. 2 depicts the trigger assembly of FIG. 1 with the breech released.

Referring to FIGS. 1 and 2, as the firing rod 7 is moved in the direction generally represented by arrow 104, the interaction between the rear end 108 of the latch 2 and the slide lock 23 at the coupling joint 25 moves the slide lock 23 downward relative to and/or within the sliding guide 24 and/or about the pivot point 24*a*.

However, if the safety device 103 is positioned in the locking position I, the securing section 8*a* supports a bottom side or surface 110 of the locking catch 21 substantially preventing the downward movement of the slide lock 23, for example. If the safety device 103 is in the unlocked position II and the firing rod 7 is actuated (e.g., moved) in a direction generally represented by arrow 104, the pulling block 14 moves (e.g., pivots) the firing mechanism 4 clockwise about the pivot point 4*a* such that the firing mechanism 4 exerts an upward force on the front end 106 of the latch 2. The rear end 108 of the latch 2 in turn exerts a downward force against the spring assembly 23*c* via the coupling joint 25 and the first pusher 23*a*. In the locking position I, the spring assembly 23*c* may be supported by the second pusher 23*b* which in turn is supported by the locking catch 21 interacting with and/or engaging the securing section 8*a* of the locking plate 8. When the second pusher 23*b* is supported by the locking catch 21, the actuating force (e.g., trigger force) affecting the firing rod 7 that urges the front end 106 of the latch 2 upwards and the rear end 108 of the latch 2 downwards may not be sufficient to compress and/or overcome a locking force of the lever 2 and, thus, to lower the sear arm 2*a* enough to release the sear catch of the breech. The locking force is associated with the biasing force of the spring assembly 23*c*.

However, the breech traveling over the latch 2 toward the rear position may have sufficient force to compress the spring assembly 23*c* (e.g., via guide ramps merging into latching rollers) when the second pusher 23*b* is supported by the locking catch 21 and, thus, to lower the rear end 108 of the latch 2 against the biasing force of the spring assembly 23*c*. Lowering the rear end 108 of the latch 2 also lowers the sear arm 2*a* that is biased by the spring assembly 23*c*. After the sear catch of the breech passes the sear arm 2*a*, the spring assembly 23*c* urges the sear arm 2*a* upward to the locking position to engage a surface of the sear catch and secure the breech in the rear position. The safety mechanism 20 includes the spring assembly 23*c* that is configured (e.g., includes a spring force) to substantially ensure that the weapon is unable to fire when the safety device 103 is in the locking position. However, the spring assembly 23*c* is configured to enable the breech to be returned to the rear position even if the safety device 103 is in the locking position.

As depicted in FIG. 2, the safety mechanism 20 enables the safety device 103 to be moved between the locked and unlocked positions even if the latch 2 is positioned (e.g., the second position) such that the breech is not locked. If the firing rod 7 is actuated in the direction generally represented by arrow 104 and then the safety device 103 is moved to the locking position I, the safety mechanism 20 is unaffected if the firing rod 7 is actuated (e.g., previously actuated). However, when the firing rod 7 is released to interrupt firing, the safety mechanism 20 and the latch 2 are able to move upward into the locking position (as shown in FIG. 1) even though the safety device 103 is moved to the locking position I (e.g., the safety position).

After the firing rod 7 is released, the spring 3 engaging the coupling joint 25 urges the latch 2 and the safety mechanism 20 upward toward the locking position. As the latch 2 and the safety mechanism 20 move upward, a surface or rear edge 202 of the locking catch 21 slides and/or engages along a front edge of the securing section 8*a*. The interaction between the rear edge 202 and the front edge of the securing section 8*a* moves and/or pivots the locking catch 21 counterclockwise about a pivot point 26. After the locking catch 21 passes and/or passes through the locking plate 8, the locking catch 21 extends and/or pivots clockwise about the pivot point 26 and interacts with the securing section 8*a* to secure the latch 2 in the locking position by substantially fixing the position of the safety mechanism 20.

While not shown, in other examples, the locking catch 21 may be rigidly fixed to the first pusher 23*a*. In such examples, the slide lock 23 and/or the first pusher 23*a* may be hinged at the coupling joint 25 to enable pivoting and/or substantially horizontal movement (e.g., forward and backward movement). To enable such movement, the latch 2 or the first pusher 23*a* may define a sliding guide or slot (not shown), for example. In such examples, as the latch 2 and the safety mechanism 20 move upward toward the locking position, the entire slide lock 23 including the locking catch 21 may pivot or swivel about the pivot point 24*a* and be displaced accordingly in the coupling joint. The locking catch 21 may engage above the locking plate adjacent the securing section 8*a*. A spring (not shown) may be positioned adjacent the slide lock 23 to implement the engaging movement and to urge the slide lock 23 backwards, for example. This spring may function as the spring 22.

The safety mechanism 20 and/or the safety device 103 may be used with the hand piece 1 (e.g., an automatic hand piece) and the safety device 103 and/or the firing rod 7 may be activated (e.g., independently activated) by remote control using control devices (e.g., actuators), for example. In other examples, the safety device 103 may be manually operated and the pulling block 14 may be replaced by a trigger mechanism (e.g., a finger operated trigger mechanism). The spring assembly 23*c* may be implemented using any suitable biasing element such as an elastomer block, for example.

The examples described herein relate to safety apparatus for use with firearms. The safety mechanism 20 interacts with and/or engages the safety device 103 when in the locking position (e.g., the safety position) to secure the latch 2 in the locking position. The safety device 103 may be moved between a locking position and a non-locking position. In the locking position the breech may be locked (e.g., retained in the rear position) and in the non-locking position the breech may not be locked (able to move back and forth), for example.

The safety mechanism 20 includes the spring assembly 23*c* acting and/or positioned between the safety device 103 and the latch 2. The spring assembly 23*c* exerts a force that secures the latch 2 in the locking position. The force exerted by the spring assembly 23*c* may be greater than (e.g., exceed) a trigger force used to move the latch 2 out of the locking position. Thus, when the safety mechanism 20 engages the safety device 103 (e.g., the locking catch 21 engages the securing section 8*a*), the trigger force is insufficient to overcome the spring force (e.g., the locking force of the lever 2) of the spring assembly 23*c* and, thus, to move the latch 2 from the locking position, release the breech and fire a shot. However, the spring force (e.g., the locking force of the lever 2) of the spring assembly 23*c* is configured to enable the breech to deflect the latch 2 against the spring force of the spring assembly 23*c* when the breech returns to the rear position. After the sear catch of the breech passes the sear arm 2*a*, the spring assembly 23*c* urges the latch 2 and the sear arm 2*a* upward to interact with the sear catch and secure the breech in the rear position (e.g., safety catch the breech).

The slide lock 23 may be coupled to the latch 2. The slide lock 23 may be displaceable based on the position and/or movement of the latch 2. The slide lock 23 includes the first pusher 23*a* hinged to the latch 2 and the second pusher 23*b* positioned in the displacement direction of the latch 2. The spring assembly 23*c* acts and/or is positioned between the first and second pushers 23*a* and 23*b* in a linear manner enabling the steady reception and transmission of power (e.g., forces). The first and second pushers 23*a* and 23*b* may be substantially linearly moveable relative to one another.

The locking catch (e.g., a spring loaded locking catch) 21 enables the interaction and/or engagement between the safety device 103 and the safety mechanism 20 when the safety device 103 and the latch 2 are positioned in the locking position. The locking catch 21 is positioned adjacent to the second pusher 23*b*. The locking catch 21 retracts (e.g., pivots about the pivot point 26) as the latch 2 moves toward the locking position when the safety device 103 is positioned in the locking position, for example.

The safety device 103 may be activated (e.g., moved and/or substantially laterally moved to the locking position) without blocking and/or preventing the functions of the latch 2. The latch 2 and the slide lock 23 may move from a position that does not lock the breech to a position that does lock the breech (e.g., the locking position) even if the safety device 103 is activated.

The locking catch 21 may be spring loaded via the spring 22. The locking catch 21 may be movable between a retracted position to an extended or catching position. The second pusher 23*b* is pivotably arranged such that when the latch 2 moves toward the locking position, the locking catch 21 extends from the retracted position after the locking catch 21 passes the safety device 103.

The latch 2 may be part of a trigger device or apparatus of the hand piece 1. A remote controlled device may be used to actuate the firing rod 7 and/or the safety device 103.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A safety mechanism configured for use with a latch of a weapon having a breech and a safety device, wherein the latch is movable between a locking position that locks the breech and a non-locking position that does not lock the breech and the safety mechanism engages the safety device when positioned in a safety position to secure the latch in the locking position, the safety mechanism comprising:

a biasing element acting between the safety device and the latch, the biasing element is associated with a locking force that fixes the latch in the locking position, wherein the locking force is greater than a trigger force used to move the latch out of the locking position but enables the latch to be deflected by a returning breech.

2. The safety mechanism as defined in claim 1, further comprising a slide lock actuatable in a displacement direction of the latch, wherein the slide lock comprises a first pusher hingably coupled to the latch and a second pusher disposed in the displacement direction of the latch.

3. The safety mechanism as defined in claim 2, wherein the first pusher is moveably coupled to the second pusher to enable linear movement relative thereto and the biasing element is positioned between and biases the first and second pushers.

4. The safety mechanism as defined in claim 2, further comprising a locking catch adjacent the second pusher, wherein as the slide lock moves toward the locking position and the safety device is positioned in the safety position, the locking catch retracts relative to the safety device.

5. The safety mechanism as defined in claim 2, further comprising a locking catch of the slide lock configured to enable the latch and the slide lock to move from the non-locking position that does not lock the breech to the locking position that locks the breech when the safety device is in the safety position.

6. The safety mechanism as defined in claim 5, wherein the locking catch is biased by a biasing element and moves toward an extended position when the latch is positioned in the locking position and the locking catch is past the safety device in the safety position.

7. The safety mechanism as defined in claim 1, further comprising one or more actuators to actuate at least one of the safety device or a trigger.

8. The safety mechanism as defined in claim 7, wherein the one or more actuators are controllable by remote control.

9. A trigger assembly configured for use with a firearm, comprising:

a latch movable between a first position and a second position, wherein in the first position the latch is to retain a breech of the firearm, and in the second position the latch is to enable movement of the breech;

a safety mechanism coupled to the latch, wherein the safety mechanism comprises a catch and a biasing element; and a safety device moveable between a locking position and a non-locking position, the safety device includes a first surface to be engaged by the catch when the safety device is in the locking position and the latch is in the first position, wherein when the safety device is in the locking position and the latch is in the first position, the biasing element prevents a trigger force from moving the latch to the second position but enables the latch to be deflected by a returning breech.

10. The trigger assembly as defined in claim 9, wherein in the locking position, the safety device is to enable the latch to move from the second position to the first position.

11. The trigger assembly as defined in claim 9, wherein an interaction between a second surface of the safety device and the catch is to pivot the catch to enable the latch to move from the second position to the first position.

12. The trigger assembly as defined in claim 9, wherein the safety mechanism comprises a first portion coupled to the latch and a second portion to which the catch is coupled.

13. The trigger assembly as defined in claim 12, wherein the biasing element is positioned between the first and second portions.

14. The trigger assembly as defined in claim 9, further comprising one or more actuators to actuate at least one of a trigger of the trigger assembly or the safety device.

15. The trigger assembly as defined in claim 14, wherein the one or more actuators are controllable by remote control.

16. The trigger assembly as defined in claim 9, wherein the catch is biased by a biasing element.

17. A safety apparatus configured for use with a firearm having a latch movable between a first position to retain a breech and a second position to enable movement of the breech, the safety apparatus comprising:

a biased safety mechanism coupled to the latch and movable between the first position and the second position; and a safety device moveable between a locking position and a non-locking position, the safety device interacts with the biased safety mechanism when the safety device is in the locking position and the biased safety mechanism is in the first position to enable the biased safety mechanism to prevent a trigger force from moving the latch to the second position but to enable the latch to be deflected by a returning breech.

18. The safety apparatus as defined in claim 17, wherein in the locking position, the safety device is to enable the biased safety mechanism to move from the second position to the first position.

19. The safety apparatus as defined in claim 17, wherein the interaction between the safety device and the biased safety mechanism when the safety device is in the locking position and the safety mechanism is in the first position comprises a biased catch of the biased safety mechanism engaging a surface of the safety device.

20. The safety apparatus as defined in claim 17, further comprising a biased catch of the biased safety mechanism, wherein the biased catch is displaceable to enable the biased safety mechanism to move from the second position to the first position when the safety device is in the locking position.

* * * * *